US008138860B2

(12) United States Patent
Marriott et al.

(10) Patent No.: US 8,138,860 B2
(45) Date of Patent: Mar. 20, 2012

(54) MAGNETICALLY-ACTIVATED MEMBRANE POTENTIOMETER

(75) Inventors: Daniel F. Marriott, Salt Lake City, UT (US); Justin Whiting, Peoa, UT (US); Sasha Rajcevich, Salt Lake City, UT (US)

(73) Assignee: Spectra Symbol, Corp., Salt Lake City, UT (US)

( * ) Notice: Subject to any disclaimer, the term of this patent is extended or adjusted under 35 U.S.C. 154(b) by 434 days.

(21) Appl. No.: 12/512,016

(22) Filed: Jul. 29, 2009

(65) Prior Publication Data

US 2011/0025451 A1 Feb. 3, 2011

(51) Int. Cl.
*H01H 51/22* (2006.01)

(52) U.S. Cl. ..... 335/78

(58) Field of Classification Search ..... 335/78; 200/181

See application file for complete search history.

(56) References Cited

U.S. PATENT DOCUMENTS

| | | | | |
|---|---|---|---|---|
| 4,367,931 | A | 1/1983 | Kawai et al. | |
| 4,425,557 | A | 1/1984 | Nakamura | |
| 5,867,082 | A | 2/1999 | Van Zeeland | |
| 5,999,083 | A | 12/1999 | Kordecki | |
| 6,127,908 | A * | 10/2000 | Bozler et al. | 333/246 |
| 6,137,387 | A | 10/2000 | Van Zeeland | |
| 6,507,187 | B1 * | 1/2003 | Olivas et al. | 324/207.21 |
| 6,646,525 | B2 * | 11/2003 | Bozler et al. | 333/246 |
| 7,119,656 | B2 * | 10/2006 | Landsberger et al. | 338/195 |
| 7,249,409 | B2 * | 7/2007 | Landsberger et al. | 29/610.1 |
| 2004/0239477 | A1 * | 12/2004 | Landsberger et al. | 338/195 |
| 2008/0164970 | A1 | 7/2008 | Malzahn | |

* cited by examiner

*Primary Examiner* — Lincoln Donovan
*Assistant Examiner* — Alexander Talpalatskiy
(74) *Attorney, Agent, or Firm* — Adam D. Stevens; Kirton & McConkie

(57) ABSTRACT

Magnetically-activated contactless potentiometers with a resistive trace and a conductive trace contained within a channel formed of non-conductive material are described. A gap between the resistive trace and the conductive trace is provided, and the conductive trace is either magnetic/ferromagnetic or is provided with a magnetic/ferromagnetic material. In use, a magnetic force is applied to the potentiometer opposite the resistive trace from the conductive trace, thus attracting the conductive trace to physically and electrically connect with the resistive trace at the location of the magnetic force. This magnetically-induced contact between the conductive trace and the resistive trace produces a resistive feedback from the point of contact and allows for changing the resistance of the potentiometer by laterally moving the magnetic force along the length of the potentiometer. The force on the conductive trace may be modified by changing the characteristics of the external magnetic force and/or the conductive trace.

18 Claims, 9 Drawing Sheets

MAGNETICALLY-ACTIVATED MEMBRANE POTENTIOMETER

BACKGROUND OF THE INVENTION

1. Field of the Invention

The present invention relates to membrane potentiometers, and more particularly to magnetically-activated membrane potentiometers.

2. Background and Related Art

Film/membrane potentiometers on the market operate in one of two distinct manners: The first type operates with an actuating pressure on the tapping pressure pin. Over time the actuating pressure on the tapping pressure pin strips the upper plastic film on the resistive path, causing the film to wear out. As the plastic film of the resistive path wears out, the resistive path may become increasingly pre-formed and as a result the top layer can pre-actuate electrically, or the contact wiper can physically tear the top layer. This decreases the life of the film potentiometers and can result in locations of lost contact. In addition, such film potentiometers require a parallel guidance of the tapping pressure pin. This increases manufacturing costs as relatively large additional structure must be provided to support and provide the guidance of the tapping pressure pin.

The second type utilizes a magnet either above the top surface of the film potentiometer or a magnet beneath the top layer of the film potentiometer, both of which cycle across the potentiometer, either on the film or directly on the conductive traces. This construction, while providing opportunities to use magnets to produce potentiometric feedback, remains limited to the abrasion of the magnet, which moves across the surfaces to produce the required feedback when the connecting magnet moves. Hence, wear and tear is still a concern when using magnets in or on the film potentiometer. An additional limitation of this style of magnetically-actuated potentiometer is the amount of magnetic force required to contact the wiper and the collector, which can be significant and may impact the usability of the product. Additionally, if there is a random separation of the two attracting magnets (one being either on top of the film potentiometer or inside the top layer and the second being below the resistive trace, "driving" the second magnet to motion across the film potentiometer), the top magnet could move to a different position without connecting to the driving magnet, thus losing electrical position.

BRIEF SUMMARY OF THE INVENTION

Implementation of the invention provides a magnetically-activated contactless potentiometer with a resistive trace and a conductive trace contained within a channel formed of non-conductive material. The resistive trace and the conductive trace may be separated along at least one edge by a non-conductive perimeter spacer material. Therefore, there is a gap between the resistive trace and the conductive trace. The conductive trace is magnetic or ferromagnetic or is bonded or otherwise connected to a magnetic or ferromagnetic material, and is therefore capable of being magnetically attracted to magnets or other sources of magnetic forces.

To use implementations of the membrane/film potentiometer, a magnetic force is applied to the potentiometer on the opposite side of the resistive trace from the conductive trace, thus attracting the conductive trace to locally connect with the resistive trace at the location of the magnetic force. This magnetically-induced contact between the conductive trace and the resistive trace produces a resistive feedback from the point of contact and allows for changing the resistance of the potentiometer by laterally moving the magnetic force along the length of the potentiometer. Thus by moving the magnetic force and attracting the conductive trace, the motion of the magnetic force produces electrical output designed to identify the location of the magnetic force. The force on the conductive trace may be modified by changing the characteristics of the external magnetic force and/or by changing the magnetic materials of the conductive trace.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

Embodiments of the invention provide a magnetically-activated contactless potentiometer with a resistive trace and a conductive trace contained within a channel formed of non-conductive material. The resistive trace and the conductive trace may be separated along at least one edge by a non-conductive perimeter spacer material. Therefore, there is a gap between the resistive trace and the conductive trace. The conductive trace is magnetic or ferromagnetic or is bonded or otherwise connected to a magnetic or ferromagnetic material, and is therefore capable of being magnetically attracted to magnets or other sources of magnetic forces.

To use embodiments of the membrane/film potentiometer, a magnetic force is applied to the potentiometer on the opposite side of the resistive trace from the conductive trace, thus attracting the conductive trace to locally connect with the resistive trace at the location of the magnetic force. This magnetically-induced contact between the conductive trace and the resistive trace produces a resistive feedback from the point of contact and allows for changing the resistance of the potentiometer by laterally moving the magnetic force along the length of the potentiometer. Thus by moving the magnetic force and attracting the conductive trace, the motion of the magnetic force produces electrical output designed to identify the location of the magnetic force. The force on the conductive trace may be modified by changing the characteristics of the external magnetic force and/or by changing the magnetic materials of the conductive trace.

Figure 1:
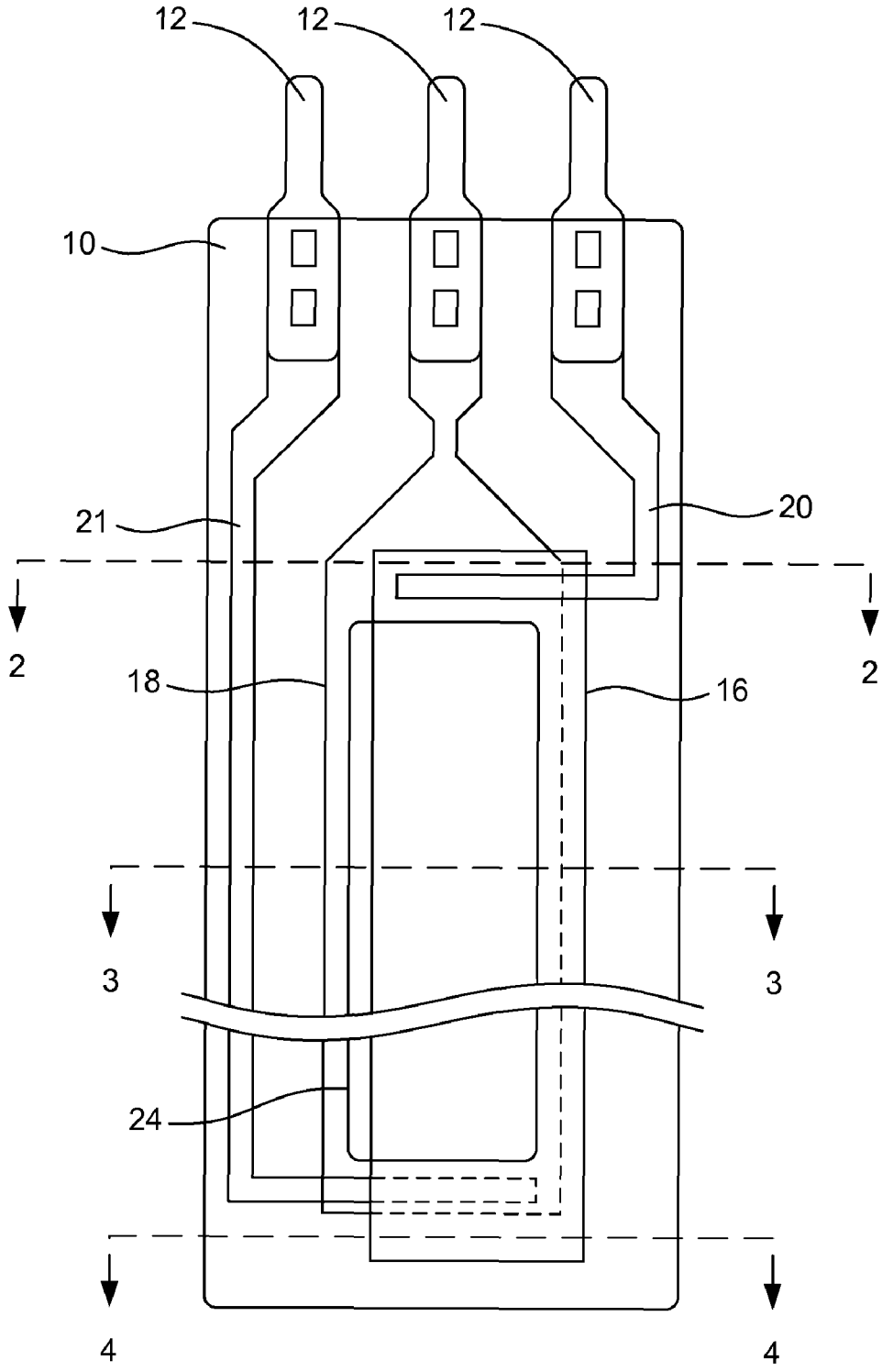
FIG. 1 shows a plan view of an embodiment of a potentiometer.
Figure 2:
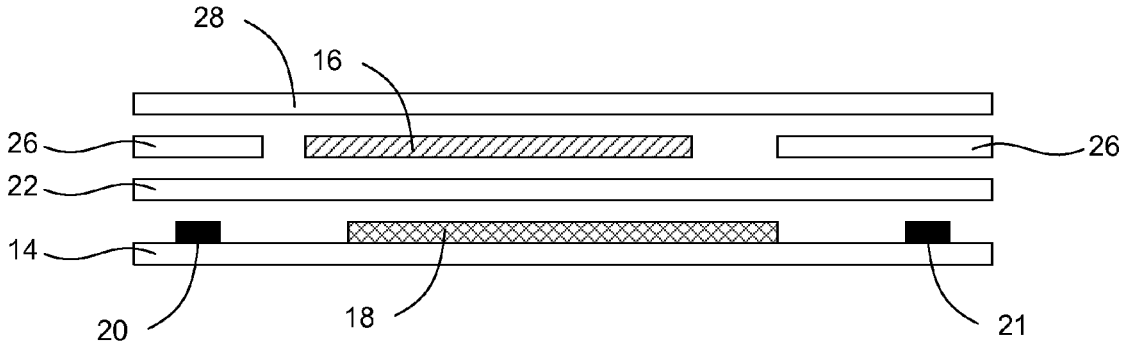
FIG. 2 shows an exploded cross-sectional view of the potentiometer of FIG. 1 taken along the line 2-2 of FIG. 1.
Figure 3:
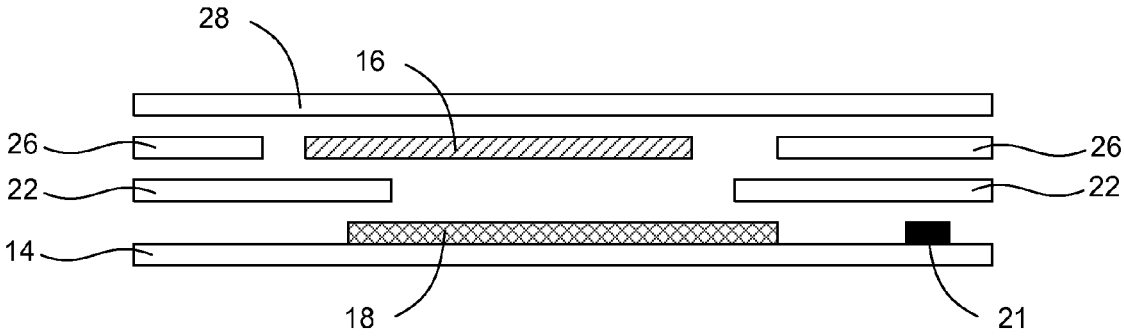
FIG. 3 shows an exploded cross-sectional view of the potentiometer of FIG. 1 taken along the line 3-3 of FIG. 1.
Figure 4:
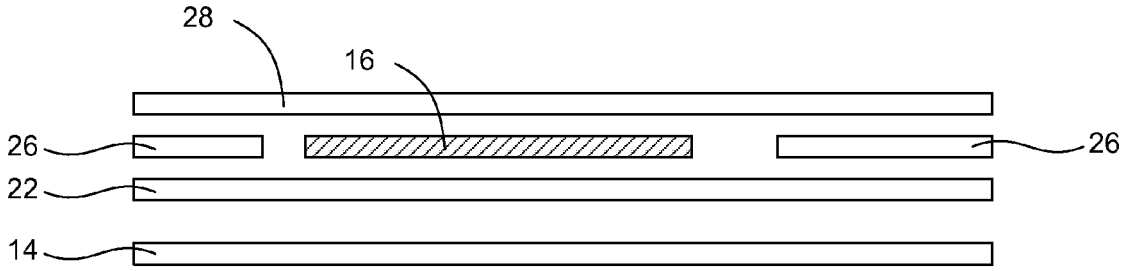
FIG. 4 shows an exploded cross-sectional view of the potentiometer of FIG. 1 taken along the line 4-4 of FIG. 1.

FIGS. 1 through 4 illustrate the components of one embodiment of a film or membrane potentiometer (hereinafter "potentiometer 10"). FIG. 1 shows a plan view of an embodiment of the potentiometer, while FIGS. 2-4 show exploded cross-sectional views of the embodiment of FIG. 1 at the locations shown by lines 2-2, 3-3, and 4-4, respectively. The potentiometer 10 may be a linear slide potentiometer having three connection terminals 12, as is well-known in the art of potentiometers. The terminals 12 facilitate making connections with the potentiometer for electrical circuits, as is known in the art. Each of the terminals 12 may be physically and electrically connected to one of three paths on a non-conductive backing 14 (see FIGS. 2-4). The backing 14 may be relatively thin and non-conductive, and may be made of a non-magnetic heat-resistive material such as epoxy or various types of plastic. The backing 14 provides structural support and strength for the potentiometer 10, as well as insulating the internal components of the potentiometer 10 from unwanted electrical contact. The overall length of the potentiometer 10 shown in FIG. 1 as well as the lengths of the exemplary paths/traces discussed below may be varied to suit the needs of the specific application in which the potentiometer 10 will be used.

As shown in FIG. 1, the rightmost terminal 12 is electrically connected by a first conductive bus bar 20 to a conductive trace 16 that may be a conductive path or conductive foil made from or incorporating any number of conductive ferromagnetic materials. As non-limiting examples, the conductive trace 16 may be made of substantially pure iron, carbon steel, any other sufficiently ferromagnetic and conductive alloy, or may be made of other conductive materials such as gold or silver attached to a ferromagnetic backing as will be discussed in more detail later. In FIG. 1, the left two terminals 12 are connected in an electronic loop that passes through a resistive trace 18 and a second conductive bus bar 21 in series, as is known in the potentiometer art. The first bus bar 20 and the second bus bar 21 may be of differing widths or thicknesses, and may be on the same or different layers of the potentiometer 10, as will be appreciated from FIGS. 2-4 and the accompanying discussion. All of the conductive trace 16, the resistive trace 18, and the bus bars 20, 21 may be placed above the top surface of the backing 14 so as to be electrically insulated from the bottom surface of the backing 14. As will be appreciated from FIGS. 2-4, the conductive trace 16 and the resistive trace 18 are configured to lie in different planes from one another, and one or both of the bus bars 20, 21 may lie on varying planes either on the same plane as one of the conductive trace 16 and the resistive trace 18, or on some other plane, according to manufacturing or design requirements.

As described above, FIG. 1 shows a three-terminal potentiometer, where the left two terminals 12 are connected in an electronic loop that passes through the resistive trace 18 and the second bus bar 21 in series. It should be understood that embodiments of the invention embrace two-terminal devices, commonly known as rheostats, where one end of the resistive trace 18 is connected to a single terminal 12, and where the other end of the resistive trace 18 is not electrically connected to any other circuit element. The functioning of such embodiments is similar to that of the three-terminal potentiometer embodiments such as illustrated in FIG. 1, and one of skill in the art will readily understand the making and using of such embodiments from this description. Therefore, the remainder of this description will refer to "potentiometers" generally, but it should be understood that in the description and in the claims, the word "potentiometer" embraces both three-terminal potentiometers and two-terminal rheostats.

Although FIG. 1 shows each of the terminals 12 exiting from one side of the potentiometer 10, the layout shown in FIG. 1 may be varied to place the location of the terminals 12 at different positions than shown, as long as the characteristics of the electrical connections between elements are maintained. These types of variations are known in the art to facilitate connection of the potentiometer 10 in whatever way is most useful for the particular application, and are embraced by the invention. The various paths, traces, and bus bars may be routed around mounting holes or any variety of other shape configurations of the backing 14 to allow the potentiometer 10 to be fixedly mounted within or for an electrical application, etc.

The resistive trace 18 may be formed by any number of materials and processes known in the art of forming such resistive paths or traces. The resistive trace 18 may be of a thickness similar to conductive trace 16, or may be of a different thickness. In one embodiment, the resistive trace 18 may be made of a special conductive resistor that is laid down on the backing 14, as is commonly used for slide or linear potentiometers.

As is more clearly shown in FIGS. 2-4, disposed between the resistive trace 18 and the conductive trace 16 is a non-conductive circuit spacer 22. The circuit spacer 22 physically separates the conductive trace 16 from the resistive trace 18 and may be placed on top of the backing 14 (and may also be placed on top of a portion of the resistive trace 18 and one or more of the bus bars 20, 21) and may be attached to the backing 14. The spacer 22 may be constructed of any material that does not provide an electrical connection between the various terminals 12, traces 16, 18 and bus bars 20, 21. Non-limiting examples of such materials include ceramics and many types of plastics. Further, the method of attaching the circuit spacer 22 to the backing 14 may be done by any method that does not provide any electrical connections between the terminals 12, traces 16, 18, and bus bars 20, 21. Non-limiting methods that may be used to attach the circuit spacer 22 to the backing 14 include gluing and laminating. As may be appreciated, the means used to attach the circuit spacer 22 may be varied to be suitable for the particular use of the potentiometer 10, such as anticipated operating temperature, anticipated flexion of the potentiometer 10, etc.

The circuit spacer 22 may comprise a cut-out or window ("window 24") that permits physical and electrical contact between a location of the conductive trace 16 and a corresponding location of the resistive trace 18 upon application of a force that brings the two traces 16, 18 together. The circuit spacer 22 and window 24 may also simultaneously seal the perimeter of the potentiometer 10 against the entry of foreign particles or environmental contaminants. As may be appreciated by one of skill in the art, the resistance between the rightmost terminal 12 and either of the two left terminals 12 may be varied by moving the location of physical and electrical contact between the conductive trace 16 and the resistive trace 18 longitudinally within the window 24.

The conductive trace 16, as set forth above and shown in FIGS. 2-4, is separated from the resistive trace 18 by the circuit spacer 22. The conductive trace 16 may have a length that is somewhat longer than the length of the window 24, as shown in FIG. 1. The conductive trace 16 in some embodiments is positioned offset to the window 24, whereby one edge and both ends of the conductive trace overlap the circuit spacer 22 adjacent the window 24 and whereby the second edge of the conductive trace 16 is positioned within the area above the window 24 except at the ends of the conductive trace 16. This positioning of the conductive trace 16 is shown in FIGS. 1 and 3.

The ends of the conductive trace 16 may be fixed to the circuit spacer 24. Attaching the ends of the conductive trace 16 secures the position of the conductive trace 16 relative to the window 24 and the resistive trace 18. In some embodiments, the edge of the conductive trace 16 positioned over the circuit spacer 24 may not be attached to the circuit spacer 24, while in other embodiments, the edge of the conductive trace 16 positioned over the circuit spacer 24 may be attached to the circuit spacer. Whether or not to attach the first edge of the conductive trace 16 to the circuit spacer 24 may be determined by the desired flexibility of the conductive trace 16 to permit making of electrical contact between the conductive trace 16 and the resistive trace 18 upon application of a certain minimum force on the conductive trace 16. It is anticipated that attaching the first edge of the conductive trace 16 to the circuit spacer 24 will require additional force on the conductive trace 16 to cause contact between the conductive trace 16 and the resistive trace 18.

In FIG. 1, the first bus bar 20 is shown connected to the conductive trace 16 near the terminal end of the potentiometer 10. In alternate embodiments, the first bus bar 20 may be connected to the conductive trace 16 at a different location, including along the entire length of the conductive trace 16 or at the distal end of the conductive trace 16. Additionally, although the first bus bar 20 is shown in FIG. 2 as being in the same plane as the resistive trace 18, it should be understood that the first bus bar 20 may instead be located in the same plane as the conductive trace 16 or in some other plane. In some embodiments, as illustrated in FIGS. 2-4, it may be desirable to seal the potentiometer 10 against dust, etc., and therefore, in some embodiments, one or more non-conductive foil spacers 26 may be placed around the conductive trace 16, with a top cover 28 placed over the conductive trace 16 and the foil spacers 26. The foil spacer(s) 26 may have a thickness equal to or greater than the thickness of the conductive trace 16 (which may be a conductive foil) to provide an opening or window between the circuit spacer 22 and the top cover 28 and within the foil spacer(s) housing the conductive trace 16.

Figure 11:
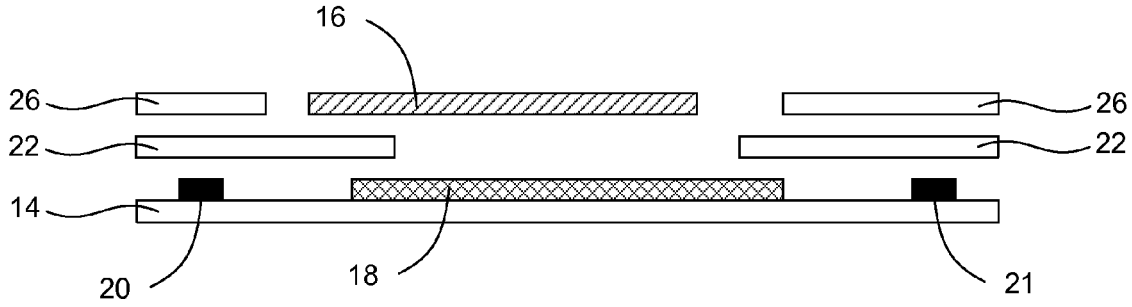
FIG. 11 shows an exploded cross-sectional view of a potentiometer similar to the view of FIG. 3, where the potentiometer does not include a top cover.
Figure 12:
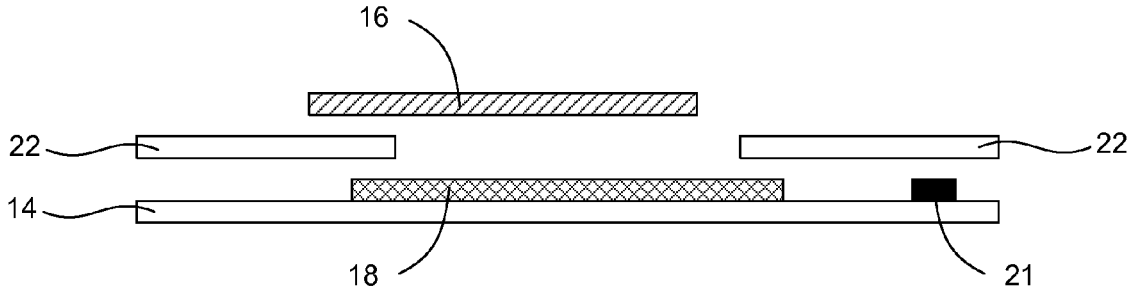
FIG. 12 shows an exploded cross-sectional view of a potentiometer similar to the view of FIG. 3, where the potentiometer does not include a top cover or non-conductive foil spacers adjacent the conductive trace.

The top cover 28 and the foil spacer(s) 26 are considered an optional feature of embodiments of the invention, as not all uses of the potentiometer 10 will require that the potentiometer 10 be sealed. In fact, in some situations, such as uses in a high- or variable-pressure environment, changing/high pressures could cause a sealed potentiometer 10 to collapse and cause unwanted contact between the conductive trace 16 and the resistive trace 18. The top cover 28 and the foil spacer(s) 26 are illustrated in FIGS. 2-4 but are not illustrated in FIG. 1 for clarity of FIG. 1 and to illustrate the fact that they are optional features of some embodiments. In addition, FIG. 11 depicts an exploded cross-sectional view of an embodiment of a potentiometer 10 not having a top cover 28 while FIG. 12 depicts an exploded cross-section view of an embodiment not having a top cover 28 or foil spacer(s) 26. Otherwise, the views of FIGS. 11 and 12 are similar to the view of FIG. 3, discussed in more detail below. Other embodiments similar to the embodiments of FIGS. 5-7 but lacking the top cover 28 or lacking the top cover 28 and the foil spacer(s) 26 are also envisioned.

As described above, FIGS. 2-4 depict exploded cross-sectional views of the potentiometer 10 at the locations of lines 2-2, 3-3, and 4-4 shown on FIG. 1, respectively. These Figures illustrate one embodiment of the various layers of the potentiometer 10. By way of illustration and clarity only, the various layers of the potentiometer 10 are illustrated as being of substantially equal thicknesses. Such is not the case in many actual embodiments of the invention. By way of example, in one non-limiting embodiment, the backing 14 and the top cover 28 have thickness of about 0.005 inches while the resistive trace 16 has a thickness of about 0.002 inches. The thicknesses of the circuit spacer 22 and the foil spacer(s) 26 may also vary from the other thicknesses as needed, and additional spacers may be included to form a complete potentiometer package. Thus, the identical thicknesses shown in FIGS. 2-4 (and of FIGS. 5-10) of the layers are not to be construed as limiting the invention.

Figure 8:
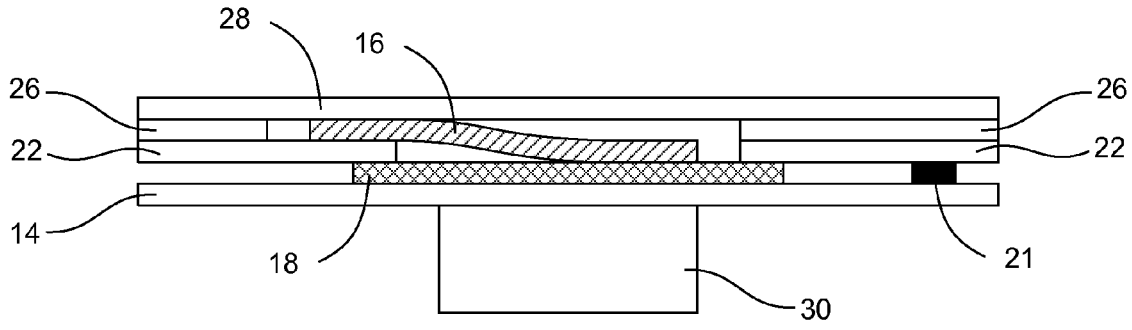
FIG. 8 shows a cross-sectional view of the potentiometer of FIG. 1 taken along the line 3-3 of FIG. 1 during activation of the potentiometer at the position of line 3-3 by a magnetic force.
Figure 10:
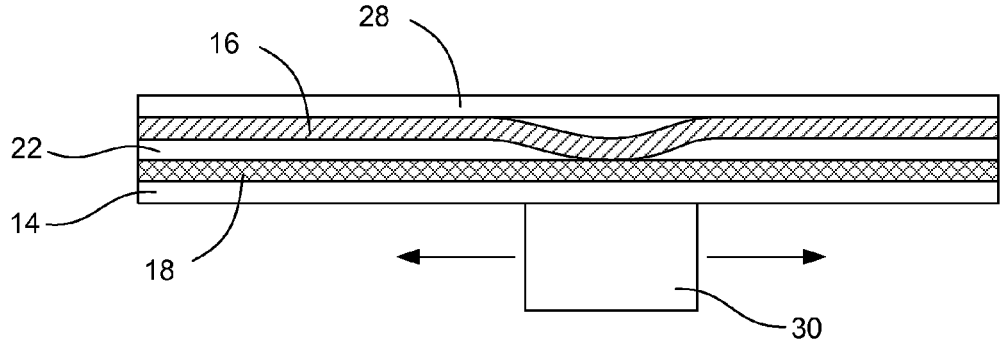
FIG. 10 shows a cross-sectional view of the potentiometer of FIG. 1 and orthogonal to the view of FIG. 8 during activation of the potentiometer by a magnetic force.

At the location of the potentiometer 10 illustrated in FIG. 2, the first bus bar 20 has not yet connected to the conductive trace 16, and the circuit spacer 22 is solid, not having the window 24 to permit contact between the conductive trace 16 and the resistive trace 18. In contrast, at the position illustrated in FIG. 3, the first bus bar 20 has connected to the conductive trace 16 (and is therefore no longer shown in this view). In addition, this location is within the window 24 formed in the circuit spacer 22, and a force that causes the free end of the conductive trace 16 to move sufficiently toward the resistive trace 18 will be permitted to cause the conductive trace 16 to make physical and electrical contact with the resistive trace 18 (as illustrated in FIGS. 8 and 10). Finally, at the location of the potentiometer 10 illustrated in FIG. 4, the distal end of the conductive trace 16 is extended beyond the window 24, permitting the end of the conductive trace 16 to be attached to the circuit spacer 22 (and/or to the top cover 28, if present). In some embodiments, the resistive trace 18 may extend this distance, along with one or more of the bus bars 20, 21, although no particular advantage is obtained by such extension.

Figure 5:
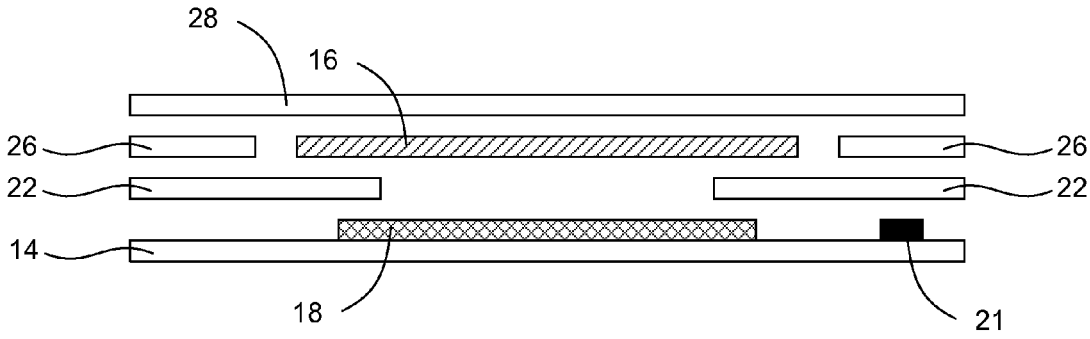
FIG. 5 shows an exploded cross-sectional view of an alternate embodiment of a potentiometer at a similar location to that shown in FIG. 3.
Figure 6:
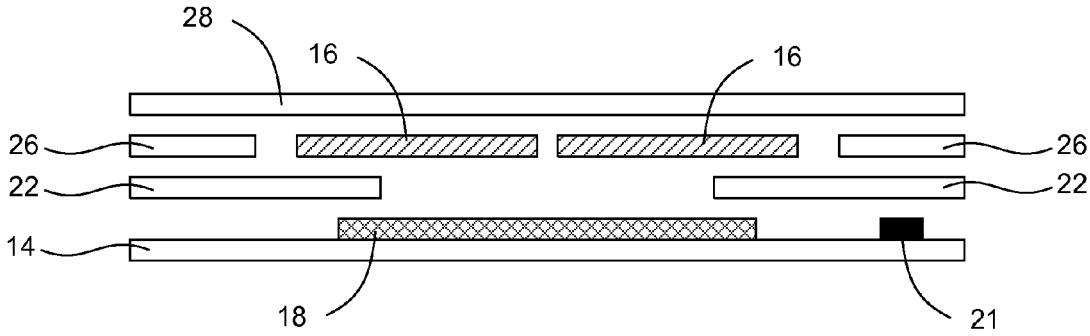
FIG. 6 shows an exploded cross-sectional view of an alternate embodiment of a potentiometer at a similar location to that shown in FIG. 3.
Figure 7:
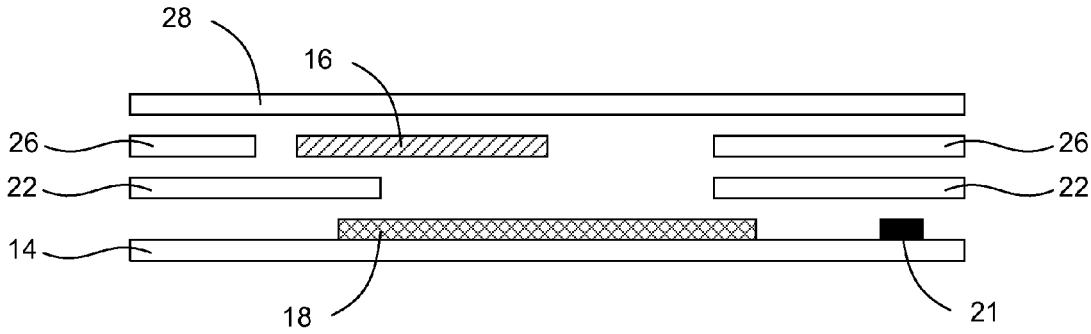
FIG. 7 shows an exploded cross-sectional view of an alternate embodiment of a potentiometer at a similar location to that shown in FIG. 3.

FIGS. 5-7 depict cross-sectional views of alternate embodiments of potentiometers such as potentiometer 10, taken within the window 24 and therefore at a location similar to that illustrated in FIG. 3. These Figures illustrate alternate embodiments of the conductive trace 16. In the embodiment of FIG. 5, the conductive trace 16 extends entirely across the window 24. As may be appreciated, a comparatively larger force will be required to cause the conductive trace 16 to contact the resistive trace 18 in the embodiment of FIG. 5 when compared with the embodiment of FIG. 3. In the embodiment of FIG. 5, both edges of the conductive trace 16 may be free from attachment to the circuit spacer 22, foil spacers 26 or top cover 28 to reduce the activating force required.

FIG. 6 represents an embodiment with two conductive traces 16. Alternatively, FIG. 6 represents an embodiment having a single conductive trace 16 (as in FIG. 5), with a central slit cut into the conductive trace 16. In this embodiment, either or both sides of the conductive trace 16 (or either or both conductive traces 16) can contact the resistive trace 18 to provide a reading from the potentiometer 10. FIG. 7 illustrates another embodiment with a narrower conductive trace 16. This embodiment and the embodiment of FIG. 3 illustrate that the width of the conductive trace 16 may be varied for various reasons, including varying the amount of force necessary to cause contact between a portion of the conductive trace 16 and a portion of the resistive trace 18. All such variations are embraced by the embodiments of the invention.

Figure 9:
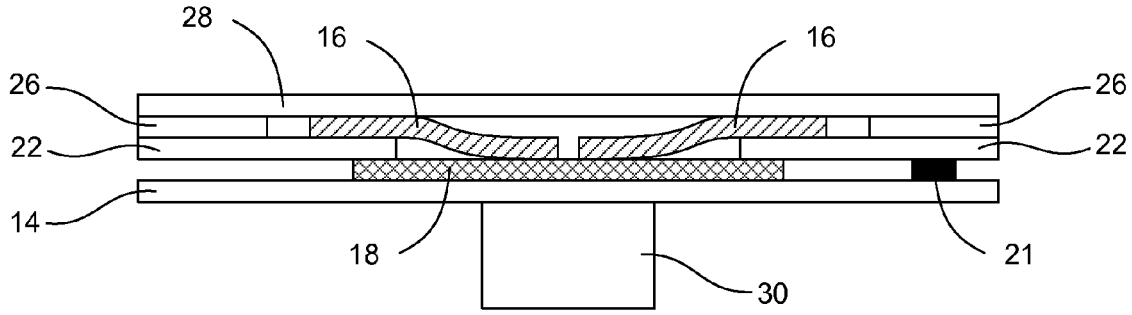
FIG. 9 shows a cross-sectional view of the potentiometer of FIG. 6 taken along a line similar to the line 3-3 of FIG. 1 during activation of the potentiometer by a magnetic force.

As has been discussed, a force is required to cause a portion of the conductive trace 16 to contact a portion of the resistive trace 18, thereby outputting an electrical reading from the potentiometer 10. In embodiments of the invention, this force is a magnetic force, and may be provided by an external control element 30, as illustrated in FIGS. 8-10. FIGS. 8-10 show representative cross-sectional views (not exploded) of embodiments of the invention, illustrating the function of the magnetic force as applied by the control element 30. The magnetic force is applied through the backing 14 and resistive trace 18 to attract a portion of the conductive trace 16 in the direction of the resistive trace 18. The magnetic force may be applied by any means known in the art, including, but not limited to, one or more permanent magnets and one or more electromagnets. Examples of permanent magnets that may be used with embodiments of the invention include various grades of neodymium-iron-boron NdFeB or other "rare-earth" magnets.

The magnitude of the magnetic force may be varied by way of experimentation to achieve the best characteristics and functionality of the potentiometer 10. By way of non-limiting example, the magnetic force may be varied by changing the strength of the applied magnetic force, such as by varying the number or size of external magnets used by the external control element 30. Additionally, the magnetic force may be varied by changing the distance of the applied magnetic force from the potentiometer, as magnetic force decreases with distance. The distance may be changed by making the backing 14 thicker or thinner, the thickness of the circuit spacer 22 thicker or thinner, or by variations provided by the external control element 30.

As another example by which the magnetic force may be varied is by changing the thickness and/or width of the conductive trace 16 or by changing the materials of the conductive trace. While substantially pure iron will theoretically be subject to more magnetic force than some other ferromagnetic materials such as steel, it has been found that the cost of substantially pure iron foil for use as the conductive trace 16 is significant. Therefore, while such foils can be used with embodiments of the invention, sufficient magnetic forces may be achieved by materials such as 1008 carbon steel, either alone or in conjunction with other materials. Embodiments have been made with conductive trace thicknesses of 0.002 inches to 0.005 inches, and other thicknesses may also be used.

Another example by which the magnetic force may be varied is by the addition of and/or variation of a magnetic layer to the conductive trace 16, as discussed below with respect to FIGS. 13-15. If a magnetic layer is added to the conductive trace 16, it may or may not contribute to conductivity of the conductive trace 16. The magnetic layer may include a ferromagnetic material or a magnetic material to further provide variability of the magnetic force. In at least some embodiments, the conductive trace 16 may be bonded or otherwise attached to the magnetic layer. For example, the conductive trace 16 may be a silver conductive material or alloy printed onto or otherwise bonded to the magnetic layer. It should be understood that two or more of the manners of varying the magnetic force discussed herein may be used in conjunction.

FIGS. 8-10 show examples of how the conductive trace 16 may deform under magnetic force (such as applied by the external control element 30) to locally contact the resistive trace 18. While FIGS. 8-9 show cross sectional views taken across the width of the potentiometer 10, FIG. 10 shows an exemplary length-wise (i.e. orthogonal to FIG. 8 or 9) cross-sectional view, showing how longitudinal displacement of the external magnetic force will cause a different reading from the potentiometer 10. As may be appreciated from these Figures, there are no moving parts within the potentiometer, and therefore there are no internal elements to be worn out by frictional motion of a tap or other element. Instead, there is local and reversible deformation of a portion of the conductive trace 16.

One additional benefit of the magnetic activation of the potentiometer 10 is that the external control element 30 is attracted to the underlying conductive trace 16 by the magnetic force applied to the conductive trace 16. Depending on the total weight of the external control element 30 and the total magnetic force, the external control element 30 may be substantially secured to the potentiometer by the magnetic force. Thereby, in some embodiments, no external guiding structure need be provided for the external control element 30, thereby reducing the total manufacturing cost of the potentiometer 10.

Embodiments of the present invention may assume many other forms. For example, while the illustrated potentiometer 10 of FIG. 1 is linear, many other shapes could be used as desired. Such possible shapes include curved, circular, spiral, or any other desired functional or decorative shape. The dimensions and characteristics of an embodiment may be modified, as described herein, according to a particular application as is known in the art.

Further, the resistive characteristics of the resistive trace 16 within the window 24 may be varied as is known in the art to create a variable resistance profile that suits a particular application. For example, the potentiometer may have a linear or logarithmic resistance profile. Although the resistive trace 16 has been illustrated as being longer and wider than the window 24, in some embodiments the resistive trace 16 may be shorter and/or narrower than the window 24.

In some embodiments, the potentiometer 10 may be configured to move or be moved by a user or by a device with which the potentiometer 10 is intended to operate, while the external control element 30 or other magnetic-force-generating element remains substantially stationary. In other embodiments, the potentiometer 10 remains substantially stationary while the magnetic-force-generating element moves.

In additional embodiments, the conductive trace 16 may have a permanent magnetic moment imparted to it. In other words, the conductive trace 16 may be magnetized or be a magnet. As may be appreciated, if the conductive trace 16 is magnetized it may affect the magnetic force necessary to cause contact between the conductive trace 16 and the resistive trace 18. It may also necessitate caution with the orientation of the magnetic field of the applied magnetic force. In some embodiments, it may be possible to utilize opposing magnetic forces in conjunction with a magnetic conductive trace 16 to improve the resolution of the potentiometer 10 or to activate the potentiometer 10 from the opposite side of the potentiometer 10 (i.e. such as from above the top cover 28). In still other embodiments and depending on the characteristics of the magnetized conductive trace 16 and the gap between the conductive trace 16 and the resistive trace 18, it may even be possible to use a non-magnetized ferromagnetic object in the external control element 30 to activate the potentiometer 10.

Figure 13:
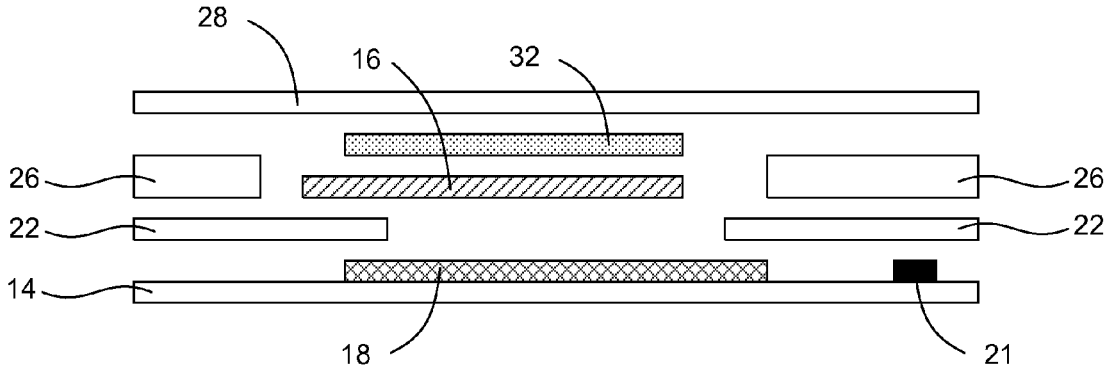
FIG. 13 shows an exploded cross-sectional view of an alternate embodiment of a potentiometer at a similar location to that shown in FIG. 3.
Figure 14:
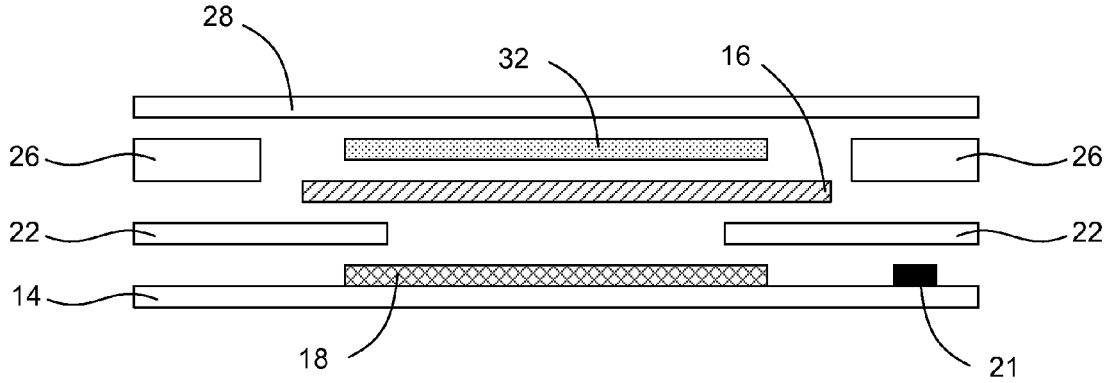
FIG. 14 shows an exploded cross-sectional view of an alternate embodiment of a potentiometer at a similar location to that shown in FIG. 3.
Figure 15:
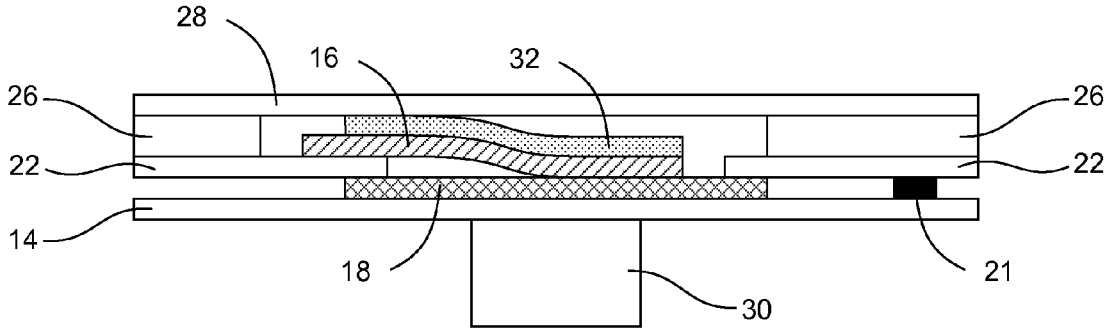
FIG. 15 shows a cross-sectional view of the potentiometer of FIG. 13 taken along a line similar to the line 3-3 of FIG. 1 during activation of the potentiometer by a magnetic force.

In still additional embodiments, as illustrated in FIG. 13-15, the potentiometer 10 includes a separate magnetic layer 32 proximate the conductive trace 16, that may or may not contribute to conductivity of the conductive trace 16, or that may even permit utilization of a second resistive element or trace in place of the conductive trace 16. The magnetic layer 32 may be used in essentially any of the embodiments discussed above with respect to FIG. 3, 5-7, or 11-12, as illustrated by the two embodiments shown in FIGS. 13 and 14. The magnetic layer 32 provides an additional component that may assist in ensuring that an applied magnetic field causes localized contact between the conductive trace 16 and the resistive trace 18 as shown in FIG. 15, and therefore may be magnetic or ferromagnetic, and may have a wide variety of properties or configurations.

The magnetic layer 32 may be bonded to or otherwise attached to the conductive trace 16, or it may be provided as a separate element adjacent to but not bonded to or otherwise attached the conductive trace 16. Alternatively, the magnetic layer 32 may be attached to the conductive trace 16 at limited locations, such as along one side of the conductive trace 16, or at each end of the conductive trace. In one embodiment, a silver conductive trace 16 is printed onto the magnetic layer 32 by any method known in the art for printing such conductive traces. In this embodiment, the silver conductive trace 16 has an improved conductivity over many ferromagnetic materials that might otherwise be used as the conductive trace 16. In embodiments having the magnetic layer 32 and the conductive trace 16, the magnetic layer 32 and the conductive trace 16 can be considered multiple layers of a conductive trace element.

In some embodiments, a discrete external control element 30 is not used. Instead, in some embodiments, the resistive trace 16 responds to a magnetic force originating with one or more devices with which the potentiometer 10 is intended to interact, such as an electric motor or similar electric device; a speaker; or another electric or electronic device generating or having a magnetic field or magnetic force capable of interacting with the embodiments of the present invention.

Figure 16:
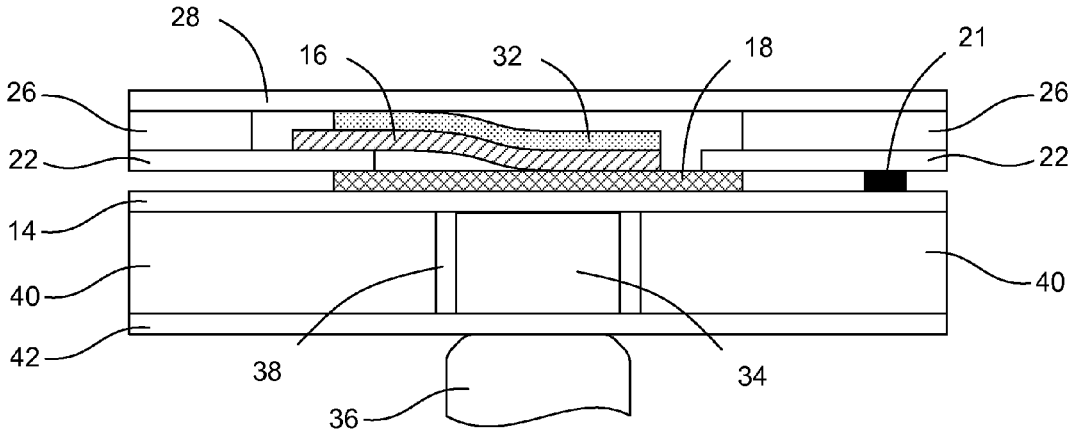
FIG. 16 shows a cross-sectional view of an alternate embodiment of a potentiometer taken along a line similar to the line 3-3 of FIG. 1 during activation of the potentiometer by a magnetic force.

In other embodiments, an internal control element 34 may be provided that is configured to interact both with the internal potentiometer elements and with an external controller 36, as illustrated in FIG. 16. The internal control element 34 is internal in that it is housed within a channel 38 located in the potentiometer 10 so as to permit activation of the potentiometer as discussed above, such as under the backing 14 and resistive trace 18. The channel 38 may be formed by one or more spacers 40 and a cover element 42 that may serve to prevent the internal control element 34 from being inadvertently removed from an effective location. The internal control element 34 may be of any material as discussed above with respect to the external control element 30.

When no external controller 36 is present, the internal control element 34 of FIG. 16 is naturally biased by magnetic attraction with the magnetic layer 32 (and/or conductive trace 16, depending on the embodiment) in a direction toward the magnetic layer 32, thereby resting against the backing 14 (with some space being possible between the internal control element 34 and the cover element 42. However, when the external controller 36 is present, it is anticipated that the external controller 36 will typically have a force of magnetic interaction between the external controller 36 and the internal control element 34 that will be significantly larger than the magnetic force between the internal control element 34 and the magnetic layer 32 (and/or conductive trace 16, depending on the embodiment). Thus, when the external controller 36 is present, it is anticipated that the internal control element 34 will normally be biased toward the cover element 42, and that some space may exist between the internal control element 34 and the backing 14. However, where such space may exist, it is limited so that a desired activation of the potentiometer is achieved.

The external controller 36 may include a variety of magnetic and/or ferromagnetic elements configured to have a desired controlling interaction with the internal control element 34. Thus, while the external controller 36 may include a permanent or electromagnet in some embodiments, in other embodiments the external controller 36 may not include a permanent magnet or an electromagnet, instead including a ferromagnetic material. In such embodiments, the magnetic force between the internal control element 34 and the external controller 36 is provided by the permanent magnetic moment of the internal control element 34.

Where the internal control element 34 and the external controller 36 both include permanent magnets and/or electromagnets, interesting potentiometer behaviors can be obtained. For example, a standard behavior can be obtained when the magnetic moments of the internal control element 34 and the external controller 36 are aligned (and thus attractive), with the potentiometer potentially serving as a present location indicator.

Figure 17:
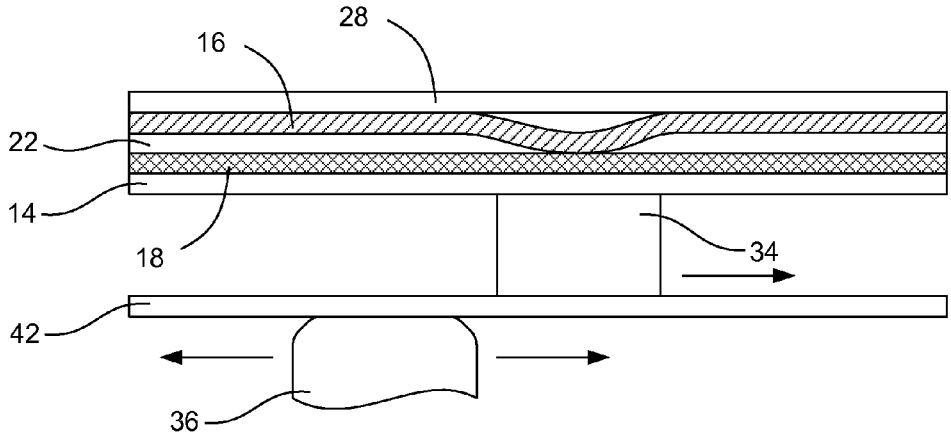
FIG. 17 shows a cross-sectional view of a potentiometer orthogonal to the view of FIG. 16, illustrating one mode of use.

A different behavior may be obtained by providing a magnetic moment of the external controller 36 that is opposite in direction to the magnetic moment of the internal control element 34. In this situation, as illustrated in FIG. 17, the external controller tends to repel the internal control element 34, whereby the potentiometer can be used as an indicator of maximum travel. In such a configuration, the external controller 36 pushes the internal control element 34 in front of it as travel occurs in one direction, then the internal control element 34 remains in place as the external controller 36 moves in the opposite direction. Each time that the external controller 36 moves farther in the initial direction of travel, it pushes the internal control element 34 farther along the potentiometer 10, and a new location of maximum travel is recorded by the activation point of the potentiometer 10. As will be appreciated, in this type of use, the magnetic moment and/or location of the external controller 36 is selected so as not to allow the external controller 36 to independently activate the potentiometer 10 at a location other than the location of the internal control element 34.

When the potentiometer 10 in such uses is to be reset for a new maximum travel measurement, either of the external controller 36 or the potentiometer 10 itself may be moved until the internal control element 34 reaches the end of the channel 38, whereby the external controller 36 passes the internal control element 34 and is then aligned to push the internal control element 34 in the opposite direction. Alternatively, in embodiments where the external controller 36 incorporates an electromagnet, the polarity of the induced magnetic field may be reversed so that the external controller 36 attracts the internal control element 34, the external controller 36 is then moved to "pick up" the internal control element 34, and is returned to a starting position. Thus, in embodiments where the external controller 36 includes an electromagnet, various types of behaviors can be utilized.

Figure 18:
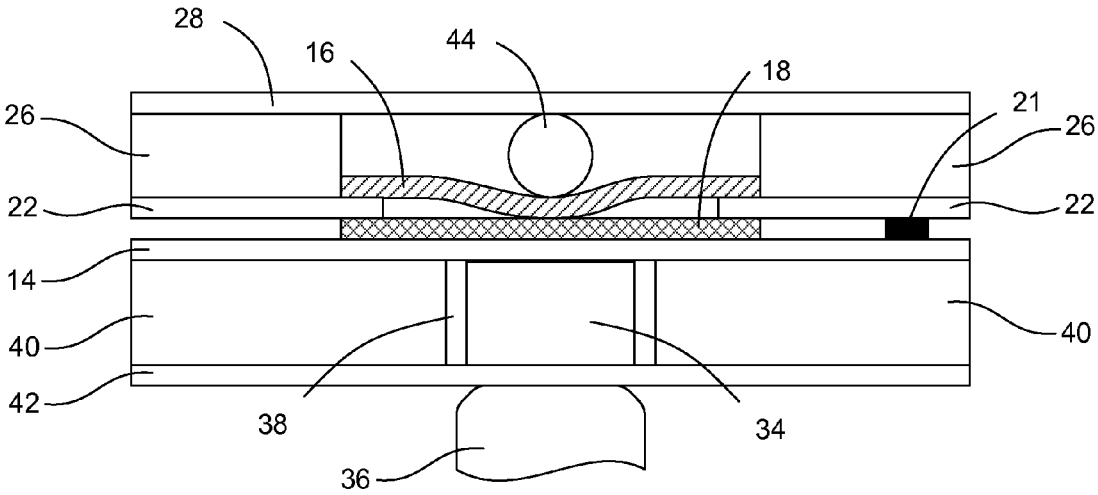
FIG. 18 shows a cross-sectional view of an alternate embodiment of a potentiometer taken along a line similar to the line 3-3 of FIG. 1 during activation of the potentiometer by a magnetic force.
Figure 19:
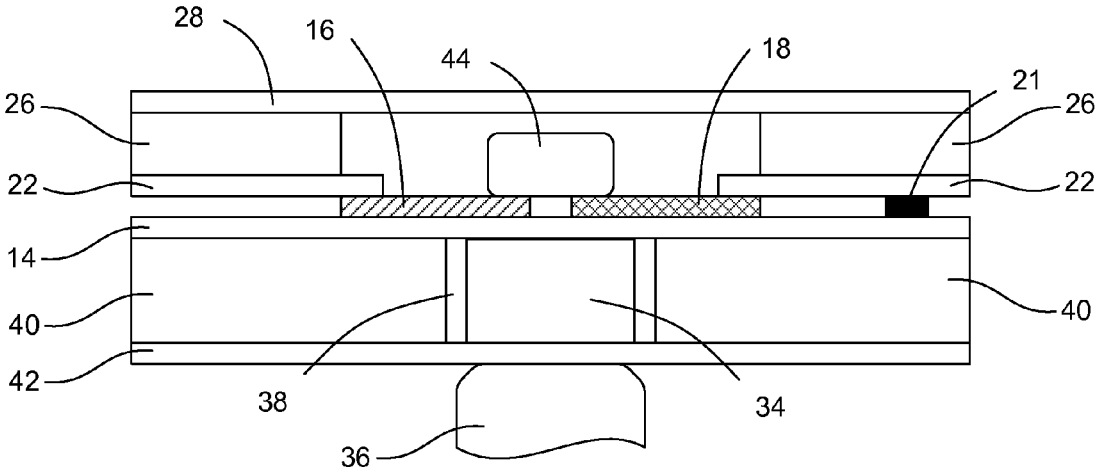
FIG. 19 shows a cross-sectional view of an alternate embodiment of a potentiometer taken along a line similar to the line 3-3 of FIG. 1 during activation of the potentiometer by a magnetic force.
Figure 20:
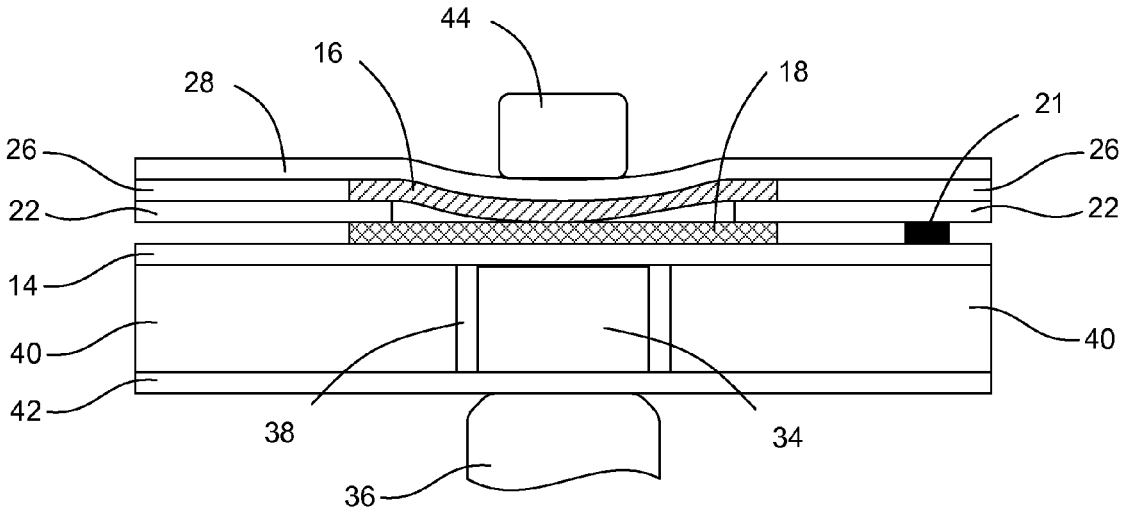
FIG. 20 shows a cross-sectional view of an alternate embodiment of a potentiometer taken along a line similar to the line 3-3 of FIG. 1 during activation of the potentiometer by a magnetic force.

Advantages provided by the internal control element 34 in the channel 38 and controlled by the external controller 36 may be useful in a wide variety of magnetically-activated potentiometers, including potentiometers other than those with a conductive trace comprising a ferromagnetic material or a ferromagnetic layer. Such potentiometers modified to include the channel 38 housing the internal control element 34 and controlled by the external controller 36 are illustrated in FIGS. 18-20. In such embodiments, an upper control element 44 controls contact between the conductive trace 16 and the resistive trace 18. The upper control element 44 is either a permanent magnet or is ferromagnetic. The provision and use of the internal control element 34 with the upper control element 44 greatly reduces the forces that needed to be applied in past devices lacking the internal control element 34. Instead, all or a portion of the necessary activating force to cause a connection between the conductive trace 16 and the resistive trace 18 using the upper control element 44 can be supplied by the internal control element 34 running in the channel 38.

FIG. 18 shows an embodiment where the upper control element 44 is spherical, and where an attractive magnetic force applied to the upper control element 44 by the inner control element 34 causes a local deformation of the conductive trace 16 that causes the conductive trace 16 to contact the resistive trace 18. This contact completes the potentiometer circuit at that location only, as the conductive trace 16 and the resistive trace 18 are normally separated to at least a small degree. In the embodiment of FIG. 19, the conductive trace 16 and the resistive trace 18 are substantially co-planar, and are separated by a central gap. The upper control element 44 bridges the gap and serves as a conductive link between the conductive trace 16 and the resistive trace 18 at that location. In the embodiment of FIG. 20, the upper control element 44 functions similarly to the embodiment of FIG. 18, with a difference being that the top cover 28 is located between the upper control element 44 and the conductive trace 16, thereby reducing wear on the conductive trace as the upper control element 44 moves along the potentiometer. Other embodiments not specifically illustrated, including embodiments similar to that of FIG. 20 where the upper control element 44 is contained within an enclosed channel, should be understood to be encompassed as embodiments of the invention.

Various embodiments of the present invention may be used in a multitude of applications, including both applications where potentiometers are currently used and could benefit from the advantages of the present invention, and also applications where potentiometers are not presently used but where a potentiometer having the characteristics of the present invention may make such use feasible or desirable. Non-limiting examples of applications of embodiments of the present invention include a liquid level sensor; a sensor of linear, non-linear, or rotary motion; or a traditional adjustable switch. Such applications may be found in industrial applications where environmental contaminants make the use of traditional potentiometers problematic, such as use as a sensor in food or chemical processing operations; in consumer goods such as appliances, including washing machines and refrigerators; in automotive products; and in many others. One illustrative example where the potentiometer may be used is as a positional sensor of a pneumatic piston having a magnet, where the contactless potentiometer may be placed externally and be activated and provide positional feedback through an internal magnet.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A potentiometer comprising:
- a resistive trace on a backing;
- a conductive trace having at least a first portion positioned near the resistive trace, the conductive trace comprising one of:
  - a ferromagnetic material;
  - a magnetic material;
  - a conductive material in conjunction with a magnetic material; and
  - a conductive material in conjunction with a ferromagnetic material; and
- a gap separating the first portion of the conductive trace from the resistive trace;
- whereby when a magnetic force is applied to the first portion of the conductive trace in the direction of the resistive trace the first portion of the conductive trace is configured to resiliently deform and contact a portion of the resistive trace.

2. The potentiometer of claim 1, further comprising a circuit spacer between the backing and the conductive trace, the circuit spacer comprising a window that forms the gap separating the first portion of the conductive trace from the resistive trace.

3. The potentiometer of claim 2, wherein the conductive trace comprises:
- a first end attached to a first end of the circuit spacer adjacent the window;

a second end attached to a second end of the circuit spacer adjacent the window;

a first edge overlapping the circuit spacer adjacent the window; and a second edge having at least a portion overlapping the window.

4. The potentiometer of claim 3, wherein the first edge of the conductive trace is not attached to the circuit spacer.

5. The potentiometer of claim 3, wherein the first edge of the conductive trace is attached to the circuit spacer.

6. The potentiometer of claim 2, wherein the conductive trace is a first conductive trace having a first edge overlapping the window, the potentiometer further comprising a second conductive trace having a first edge that is substantially adjacent the first edge of the first conductive trace.

7. The potentiometer of claim 2, wherein the conductive trace comprises a longitudinal slit positioned over the window.

8. The potentiometer of claim 2, further comprising a foil spacer and a cover.

9. The potentiometer of claim 1, wherein the conductive trace comprises multiple layers, at least one of the layers being one of a ferromagnetic material and a magnetic material.

10. The potentiometer of claim 1, wherein the conductive trace comprises steel foil having a thickness between about 0.001 inches and about 0.005 inches.

11. The potentiometer of claim 10, wherein the steel foil has a thickness of about 0.002 inches.

12. The potentiometer of claim 1, wherein the conductive trace comprises a ferromagnetic material selected from the group consisting of:

iron;

steel;

nickel;

cobalt; and alloys thereof.

13. The potentiometer of claim 1, further comprising an external control element configured to apply the magnetic force to the conductive trace.

14. A potentiometer comprising:

a backing having a top surface and a bottom surface;

a resistive trace attached to the top surface of the backing;

a circuit spacer attached to the backing around the resistive trace, the circuit spacer comprising a window exposing at least a portion of the resistive trace within the window; and a conductive trace having first and second ends attached to the circuit spacer adjacent the window, the conductive trace comprising one of a ferromagnetic material and a magnetic material and further comprising:

a first edge positioned over the circuit spacer adjacent the window; and a second edge with at least a portion positioned over the window above the resistive trace and separated from the resistive trace by a gap corresponding to the circuit spacer.

15. The potentiometer of claim 14, further comprising an external control element configured to apply a magnetic force adjacent the bottom surface of the backing, thereby attracting a portion of the conductive trace and causing the portion of the conductive trace to deform and contact a portion of the resistive trace.

16. The potentiometer of claim 14, wherein the conductive trace comprises multiple layers, at least one of the layers being one of a ferromagnetic material and a magnetic material.

17. A method for magnetically activating a potentiometer, comprising:

providing a potentiometer comprising:

a backing having a top surface and a bottom surface;

a resistive trace attached to the top surface of the backing;

a circuit spacer attached to the backing around the resistive trace, the circuit spacer comprising a window exposing at least a portion of the resistive trace within the window; and a conductive trace having at least one portion attached to the circuit spacer adjacent the window, the conductive trace comprising one of a ferromagnetic material and a magnetic material and further comprising:

a first edge positioned over the circuit spacer adjacent the window; and a second edge with at least a portion positioned over the window above the resistive trace and separated from the resistive trace by a gap corresponding to the circuit spacer; and providing a magnetic force adjacent the bottom surface of the backing of the potentiometer whereby the magnetic force engages a portion of the conductive trace, causing the portion of the conductive trace to deform and contact a portion of the resistive trace.

18. The method of claim 17, further comprising moving the magnetic force along the bottom surface of the backing, thereby causing a different portion of the conductive trace to deform and contact a different portion of the resistive trace.

* * * * *